US008072474B2

(12) United States Patent
Nishimura et al.

(10) Patent No.: US 8,072,474 B2
(45) Date of Patent: Dec. 6, 2011

(54) CLEANING APPARATUS FOR ROLLER AND PRINTING APPARATUS USING CLEANING APPARATUS

(75) Inventors: Takanobu Nishimura, Chigasaki (JP); Hiroyuki Mori, Sagamihara (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 325 days.

(21) Appl. No.: 12/404,541

(22) Filed: Mar. 16, 2009

(65) Prior Publication Data

US 2009/0268004 A1 Oct. 29, 2009

(30) Foreign Application Priority Data

Apr. 23, 2008 (JP) ..... 2008-113057
Jan. 6, 2009 (JP) ..... 2009-000919

(51) Int. Cl.
*B41J 2/32* (2006.01)
*G01D 15/10* (2006.01)

(52) U.S. Cl. ..... 347/171; 347/22; 347/220

(58) Field of Classification Search ..... 347/22, 347/171, 220
See application file for complete search history.

(56) References Cited

U.S. PATENT DOCUMENTS 5,414,449 A * 5/1995 Buan et al. ..... 347/217
5,448,282 A * 9/1995 Imai et al. ..... 347/213
2002/0023307 A1 2/2002 Haba et al.

FOREIGN PATENT DOCUMENTS

JP 2003-054144 2/2003
JP 2005-225168 8/2005

OTHER PUBLICATIONS

Korean Office Action dated Jan. 25, 2011.
"The ABC of Rubber Technology"; The Society of Rubber Industry, Japan; pp. 40-41; Jun. 20, 2005.

* cited by examiner

*Primary Examiner* — Daniel Petkovsek
(74) *Attorney, Agent, or Firm* — Pillsbury Winthrop Shaw Pittman, LLP

(57) ABSTRACT

A cleaning apparatus for a roller includes a platen roller and a cleaning roller brought into contact with the platen roller to clean a surface of the platen roller, where the cleaning roller is configured such that SP values (dissolution parameter) of the cleaning roller and of all additives added in the cleaning roller have differences of at least 2.0 from an SP value of the platen roller.

18 Claims, 11 Drawing Sheets

A: Antistatic agent-removed rubber
B: Interfacial active agent-removed rubber
C: Rubber sheet containing antistatic agent and interfacial active agent
D: Both antistatic agent and interfacial active agent-removed rubber

CLEANING APPARATUS FOR ROLLER AND PRINTING APPARATUS USING CLEANING APPARATUS

CROSS-REFERENCE TO RELATED APPLICATIONS

This application is based upon and claims the benefit of priority from prior Japanese Patent Applications No. 2008-113057, filed Apr. 23, 2008; and No. 2009-000919, filed Jan. 6, 2009, the entire contents of both of which are incorporated herein by reference.

BACKGROUND OF THE INVENTION

1. Field of the Invention

The present invention relates to a cleaning apparatus which cleans a platen roller of a printing apparatus and a printing apparatus using the cleaning apparatus, for example.

2. Description of the Related Art

As a printing apparatus, an apparatus of a thermal transfer type where ink of a thermal transfer ink ribbon is thermally transferred to an image receiving layer of an intermediate transfer film to form an image, and pressure and heat are applied to the image so that an image for personal authentication such as, especially, a license or a passport, or a character image such as personal information is recorded on a medium to be recorded has been known.

Such a printing apparatus is provided with a thermal head and a platen roller made of, for example, urethane rubber and spaced from the thermal head in a facing manner thereto. A melting ink ribbon and an intermediate transfer film disposed in a superimposed state are interposed between the thermal head and the platen roller.

The thermal head comes into pressure contact with the platen roller via the melting ink ribbon and the intermediate transfer film to heat the melting ink ribbon and the intermediate transfer film, thereby printing an image on an image reception and adhesion layer surface of the intermediate transfer film.

A cleaning roller for cleaning a surface of the platen roller is provided near the platen roller. The cleaning roller comes in contact with a surface of the platen roller to rotate according to rotation of the platen roller, thereby removing dirt on the platen roller (see Jpn. Pat. Applin. KOKAI Publication No. 2005-225168, for example).

Now, such a phenomenon that the platen roller swells according to degree of use of the platen roller so that its diameter becomes uneven along an axial direction of the platen roller takes place. When this phenomenon takes place, contact pressure between the platen roller and the intermediate transfer film becomes uneven along the axial direction, so that such a problem that difference between dark and light in the axial direction occurs on a printed image. It is thought that the swelling of the platen roller is caused by a relationship between the cleaning roller and the platen roller at a step of bringing the cleaning roller into contact with the platen roller and rotating the cleaning roller according to rotation of the platen roller at a fixed time interval for cleaning dirt of the platen roller.

In the conventional art, however, a platen roller made of urethane rubber and a cleaning roller made of rubber are used, but swelling of the platen roller cannot be prevented sufficiently. Therefore, contact pressure between the platen roller and the intermediate transfer film becomes uneven in the axial direction, which results in such a problem that a dark and light pattern along the axial direction occurs on a printed image.

BRIEF SUMMARY OF THE INVENTION

In view of these circumstances, one aspect of the present invention has been made and an object thereof is to provide a cleaning apparatus which perform cleaning without causing swelling of a roller and a printing apparatus which can print an image with high quality without being affected by swelling of a platen roller.

According to one aspect of the present invention, there is provided a cleaning apparatus comprising a roller; and a cleaning roller brought into contact with the roller to clean a surface of the roller, wherein the cleaning roller is configure such that SP values (dissolution parameters) of the cleaning roller and of all additives added in the cleaning roller have differences of at least 2.0 from the SP value of the roller.

According one aspect of the present invention, there is provided a printing apparatus comprising a thermal head brought into pressure contact with an ink ribbon superimposed on an intermediate transfer film to heat the ink ribbon, thereby printing an image on the intermediate transfer film; a platen roller supporting the ink ribbon and the intermediate transfer film with which the thermal head is brought into pressure contact; a transfer device transferring the image printed on the intermediate transfer film to a body to be transferred at a transfer position, and a cleaning roller brought into contact with the platen roller to clean a surface of the platen roller, wherein the cleaning roller is configured such that SP values (dissolution parameter) of the cleaning roller and of all additives added in the cleaning roller have differences of at least 2.0 from the SP value of the platen roller.

According to one aspect of the present invention, a cleaning apparatus which can clean a roller without causing the roller to swell and a printing apparatus which can print an image with high quality without being affected by swelling of a platen roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be explained below in detail with reference to the drawings.

First Embodiment

Figure 1:
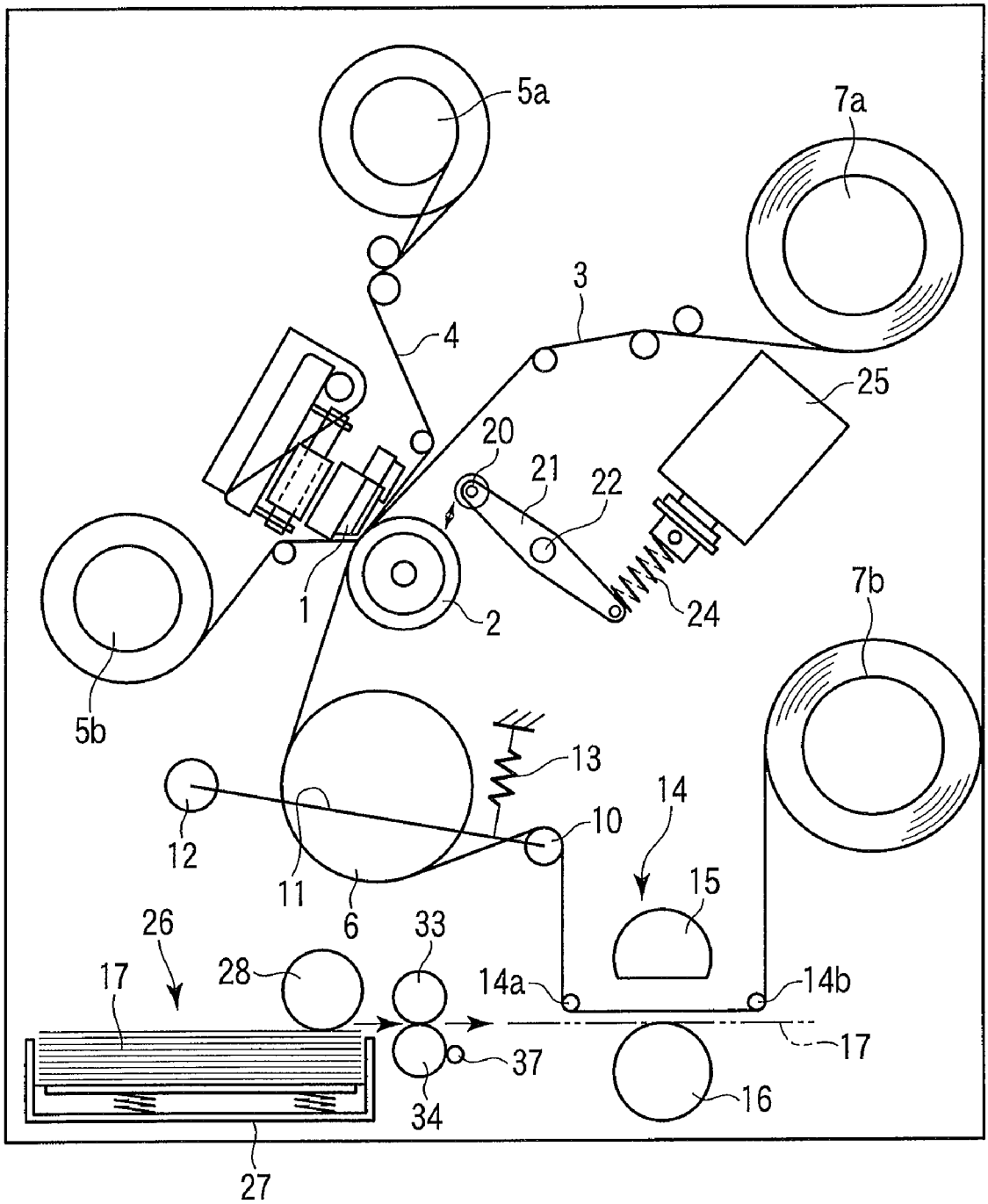
FIG. 1 is a schematic configuration diagram showing a printing apparatus of a thermal transfer type according to one embodiment of the present invention.

FIG. 1 is a schematic configuration diagram showing a printing apparatus of a thermal transfer type according to one embodiment of the present invention.

The printing apparatus of a thermal transfer type has such features that image permanence is high, it is relatively easy to apply functionality material to ink material (for example, fluorescent pigment, aluminum vapor deposition thin film), and the like, and it is suitable for printed matter for preventing forgery.

The thermal transfer type printing apparatus is provided with a printing unit, and a thermal head 1 serving as a printing head and a platen roller 2 spaced from the thermal head 1 and facing the same are disposed within the printing unit. An intermediate transfer film 3 and a melting ink ribbon 4 superimposed on the intermediate transfer film 3 are interposed between the thermal head 1 and the platen roller 2.

One end of the melting ink ribbon 4 is wound on a supplying core 5*a*, while the other end thereof is wound on a take-up core 5*b*. One end of the intermediate transfer film 3 is wound on a supplying core 7*a* and the other end thereof is wound on a take-up core 7*b*.

A film driving roller 6 caused to abut the intermediate transfer film 3 in a turning manner to impart conveying force to the intermediate transfer film 3 is provided below the platen roller 2. A tensioning roller 10 imparting tension to the intermediate transfer film 3 is provided downstream of the film driving roller 6 in a transfer film conveying direction. The tensioning roller 10 is rotatably attached to a distal end portion of a rotating lever 11. The rotating lever 11 is rotatably supported about supporting shaft 12 and it is biased by a spring 13 so as to be rotatable upwardly.

Guide pins 14*a* and 14*b* guiding conveyance of the intermediate transfer film 3 are disposed downstream of the tensioning roller 10 in the transfer film conveying direction, and a heat roller 15 configuring an image transfer section (transfer device) 14 is provided between the guide pins 14*a* and 14*b*. A backup roller 16 is provided below the heat roller 15. A medium 17 serving as a body to be transferred is conveyed between the heat roller 15 and the backup roller 16. The medium 17 is supplied by a supplying apparatus 26 described in detail later.

As the thermal head 1, one of a near edge or of a corner edge type is used, so that printing based upon thermal time peeling-off is performed. In the printing unit, stably controllable printing dot realizing printing excellent in gradation characteristic is in a range from 30 μm to solid printing. This means that 0.25 can be obtained stably as a lower limit of reflection concentration in a single color printing. A base film thickness and an ink layer thickness of the melting ink ribbon 4 are considerably important parameters regarding printing dot reproducibility, where an ink ribbon layer thickness is in a range from 3 to 25 μm, preferably in a range from 4 to 10 μm.

On the other hand, a base film thickness and image reception and adhesion layer thickness of the intermediate transfer film 3 are parameters influencing adhesiveness and film discontinuation property, where the layer thickness of the intermediate transfer film 3 is in a range from 10 to 100 μm, preferably in a range from 25 to 50 μm.

As the film driving roller 6, a roller having a hardness in a range from 30° to 60° is used, and it is preferable that a winding angle of the transfer film 3 to the driving roller 6 is large as much as possible. In Example, a mechanism where a winding angle in a range from 90 to 130° can be obtained is adopted. The film driving roller 6 is driven such that accurate conveyance is performed in combination of a 5-phase stepping motor, a timing belt, and a reduction mechanism comprising a pulley.

Next, printing operation of the abovementioned thermal transfer type printing apparatus will be explained.

At a printing time, the thermal head 1 generates heat based upon print information, and the melting ink ribbon 4 and the intermediate transfer film 3 are conveyed. Ink contained in the melting ink ribbon 4 is transferred to the intermediate transfer film 3 so that an image is printed according to the heat generation of the thermal head 1. The image printed on the intermediate transfer film 3 is fed to the image transfer section 14. At this time, the medium 17 is conveyed to the image transfer section 14, it is superimposed on the intermediate transfer film 3, and the intermediate transfer film 3 is heated and pressurized according to rotation of the heat roller 15, so that the image is transferred on the medium 17. After the transfer, the medium 17 is discharged to a discharge section and the intermediate transfer film 3 is wound on the take-up core 7*b*.

Now, a cleaning roller 20 for cleaning a surface of the platen roller 2 is provided near the abovementioned platen roller 2. The cleaning roller 20 is rotatably attached to one end portion of the rotating lever 21. The rotating lever 21 is rotatably supported at its intermediate portion by a supporting shaft 22, and the other end portion of the rotating lever 21 is connected with a solenoid 25 via a spring member 24. According to energization/de-energization of the solenoid 25, the rotating lever 21 is rotated so that the cleaning roller 20 is brought into contact with/separated from the platen roller 2.

The surface of the platen roller 2 gets dirty according to continuation of the printing operation, but the dirt is cleaned by the cleaning roller 20. That is, the solenoid 25 is energized, the rotating lever 21 is rotated about the supporting shaft 22 in a counterclockwise direction, and the cleaning roller 20 is brought into contact with the surface of the platen roller 2 at the cleaning time. By the contact, the cleaning roller 20 is rotationally driven according to rotation of the platen roller 2 so that the surface of the platen roller 2 is cleaned. When the cleaning is terminated, the solenoid 25 is de-energized, and the rotating lever 21 is rotated about the supporting shaft 22 in a clockwise direction, so that the cleaning roller 20 is separated from the surface of the platen roller 2.

The abovementioned platen roller 2 swells according to degree of use. It is determined that the swelling is caused by component transfer from the cleaning roller 20 to the platen roller 2 occurring at a step of bringing the cleaning roller 20 into contact with the platen roller 2 to rotate the cleaning roller 20 according to rotation of the platen roller 2 at a fixed time interval for cleaning dirt of the platen roller 2. The swelling will be explained in detail later.

Next, selection of rubber material configuring the abovementioned platen roller 2 will be explained.

Figure 2:
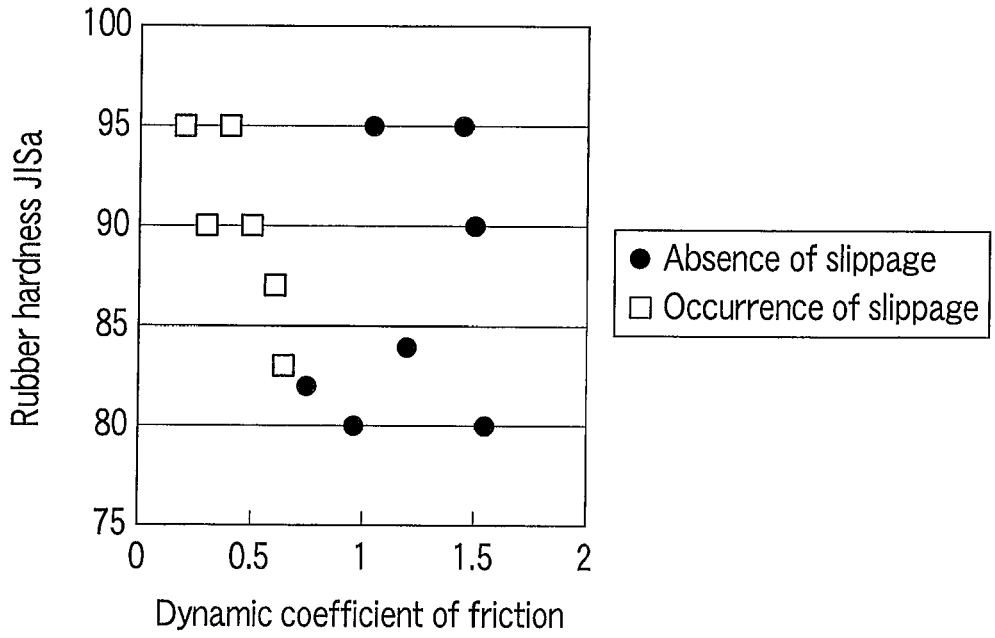
FIG. 2 is a graph showing a relationship between a dynamic friction coefficient of a platen roller to an intermediate transfer film and rubber hardness.

FIG. 2 shows a relationship between dynamic friction coefficient of the platen roller 2 and presence/absence of blur of print dots, namely, presence/absence of slippage between the platen roller 2 and the intermediate transfer film 3. This experiment was performed using the platen roller 2 having Hardness higher than JIS A Hardness of 80° or higher at a sliding speed of 50 mm/s under a load of 100 g.

FIG. 2 shows such a fact that, when the dynamic friction coefficient between the intermediate transfer film 3 and the platen roller 2 is 0.75 or higher, slippage between the platen roller 2 and the intermediate transfer film 3 does not occur. In general, there is such a tendency that the frication coefficient of rubber lowers according to rising of hardness thereof. Since the platen roller 2 in this invention is limited to JIS A Hardness of 80° or higher in order to assure quality of print dots, selection of rubber material is limited.

Figure 3:
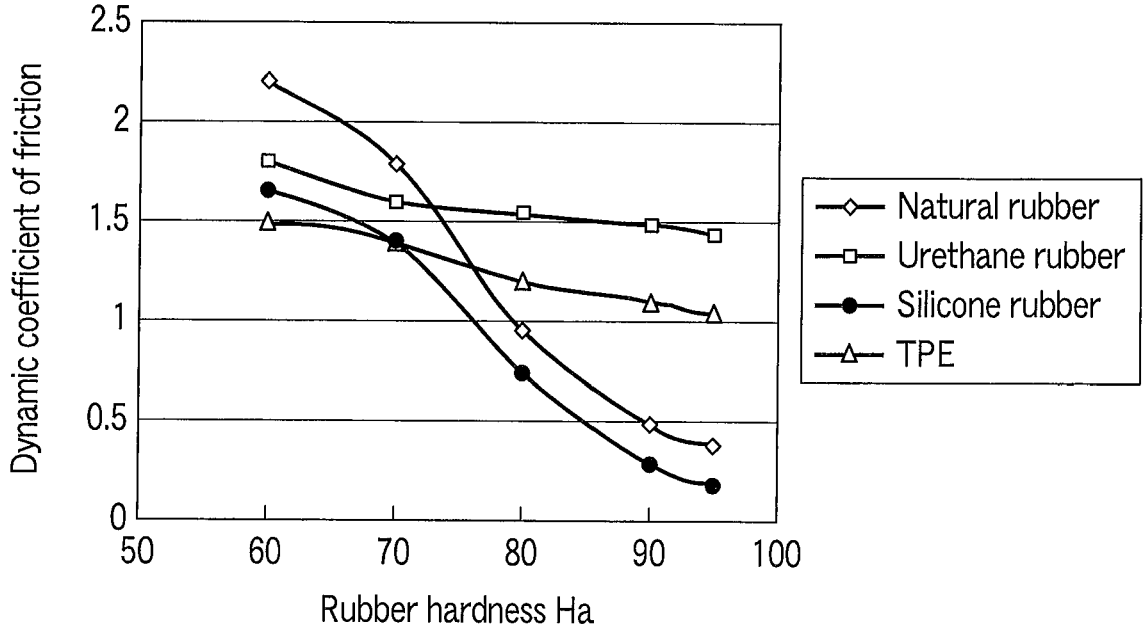
FIG. 3 is a graph showing a relationship between hardnesses and dynamic friction coefficients in various rubber materials.

FIG. 3 shows a relationship between rubber hardnesses of natural rubber, silicone rubber, urethane rubber, and thermoplastic elastomer (TPE), and friction coefficients.

The thermoplastic elastomer (TPE) is material obtained by blending urethane series elastomer into EPDM rubber. The friction coefficient of the natural rubber or the silicone rubber lowers largely according to rising of the hardness, but lowering of the friction coefficients of the urethane rubber and the TPE according to rising of the hardness is gentle, and the urethane rubber and the TPE maintain relatively high friction coefficients even in rubber hardness JIS A Hardness of 80° or higher.

This will be because the urethane rubber has a molecular structure obtained by mixing two phases of hard segment and soft segment, which is different from ordinary rubbers.

Since such a composite effect that the hard segment assumes high rubber hardness and the soft segment assumes elasticity and a frication coefficient of the rubber is provided, high hardness and high friction coefficient can be achieved. Therefore, the urethane rubber has such a feature that characteristics in a wide range from soft rubber to tough rubber falling within plastic level can be provided according to components of the urethane rubber.

Since the two-phase mixing tissue structure can impart pressure by a plane close to a flat face in a fine contact portion of print dot level of the thermal head 1, high quality print where edge of print dot is clear can be obtained. Further, it is thought that, since elasticity is developed by the whole roller, even contact with the thermal head 1 or a printing plate can be achieved.

Similarly, the TPE also has the soft segment which is a soft component having a high friction coefficient and the hard segment which is a molecular confinement component according to blending of rubber components of at least two kinds. As one example of blending for providing high friction coefficient and high hardness, EPDM rubber is used as hard segment material and urethane series thermoplastic elastomer which is a main component is blended as soft segment material. After urethane series thermoplastic elastomer pellets together with compatibilizer and a cross-linking agent are blended and mixed to the EPDM rubber in a ratio of 50 of the former to 100 of the latter, the mixed material is heated to 200° C. and kneaded to be charged in a mold set with a roller shaft and it is dynamically cross-linked so that molding is performed by an excluder.

As described above, by performing selection from rubber materials having the two-phase mixing tissue structure of hard segment and soft segment, a platen roller 2 where the rubber hardness is JIS A Hard of 80° or higher and dynamic friction coefficient to the thermal transfer film 3 is 0.75 or higher can be obtained, so that print with high quality which does not include a dark and light pattern extending in a film advancing direction (a rotational direction of the platen roller) can be obtained while avoiding slippage between the platen roller and the intermediate transfer film 3.

Next, selection of rubber material configuring the abovementioned cleaning roller 20 will be explained. Such a phenomenon that the platen roller 2 swells according to degree of use of the platen roller 2 so that a diametric size thereof in an axial direction becomes uneven takes place. A dark and light pattern occurs on print in a direction perpendicular to the advancing direction of the intermediate transfer film 3 due to occurrence of the phenomenon. The swell of the platen roller 2 is caused by component transfer from the cleaning roller 20 to the platen roller 2 at a step of bringing the cleaning roller 20 into contact with the platen roller 2 to rotate the cleaning roller 20 according to rotation of the platen roller 2 at a fixed interval for cleaning dirt of the platen roller 2.

As substances which are easily transferred from the cleaning roller 20 to the platen roller 2, there are materials with high affinity with rubber material configuring the platen roller, and determination about the affinity is made based upon whether or not the SP value of substance for the cleaning roller 20 is close to that of substance for the platen roller 2. The SP value is called "dissolution parameter", and since it is assumed that force acting between solvent and solute is only force between molecules, the dissolution parameter is used as a scale representing force between molecules. It is known empirically that solubility becomes large according to reduction of a difference between SP values of two components. Measurement of the SP value is not easy so that the SP value is frequently determined from presence/absence of affinity with solvent to which known measurement data is present.

Here, a selecting method of cleaning roller material to the platen roller 2 made of urethane rubber shown as one example of rubber material for the platen roller 2 will be explained.

It is known that the SP value of the urethane rubber is 10.0. It is preferable that, if cleaning roller material with reduced component transfer to the urethane rubber is selected, material with an SP value largely separated from 10.0 is selected. As rubber materials having a relatively small SP value and high adhesiveness, there are EPDM rubber and butyl rubber whose SP values are 7.9 and 7.8. However, it is known empirically that, even if rubber materials with SP values separated from 1.0 are used, the platen roller made of urethane rubber cannot be prevented from swelling sufficiently.

Figure 4:
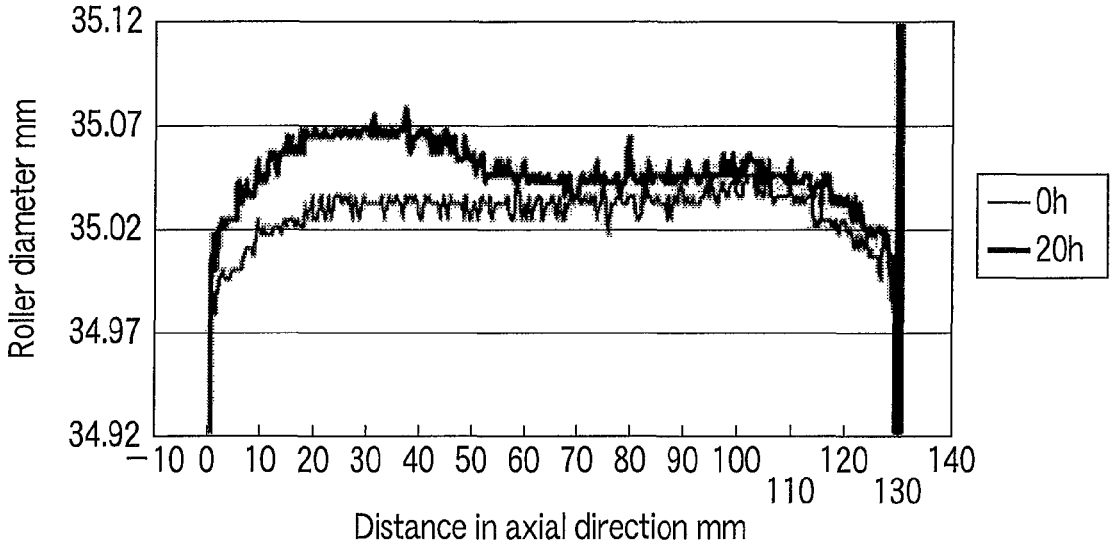
FIG. 4 is a graph showing a diametric distribution of a swollen platen roller in an axial direction thereof.
Figure 5:
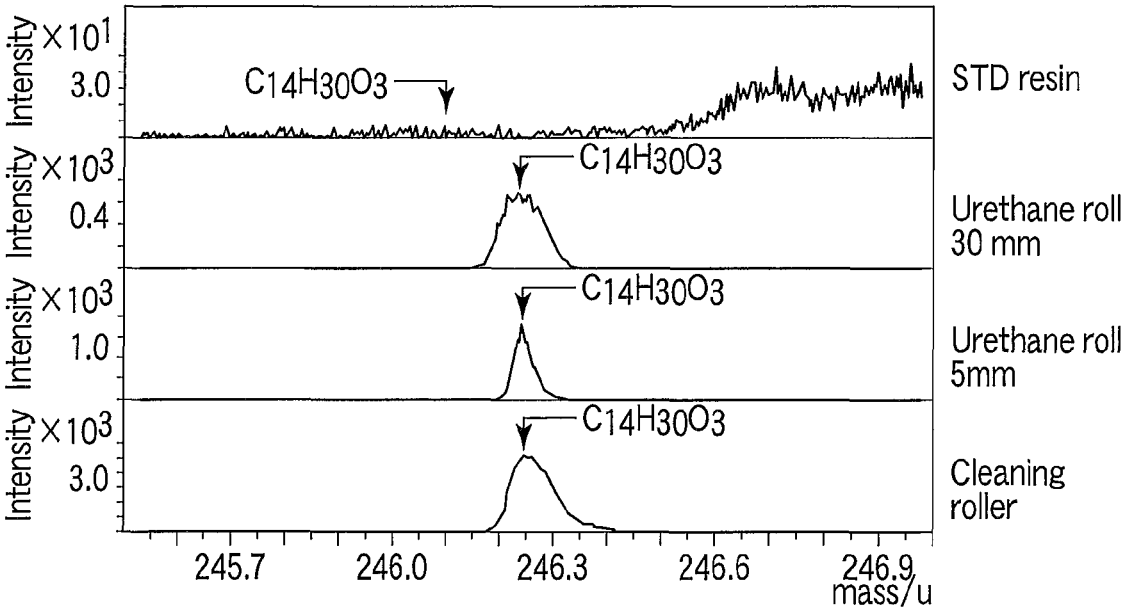
FIG. 5 is a graph showing analysis spectrum of components which have been transferred from a cleaning roller to a urethane rubber roller.
Figure 6:
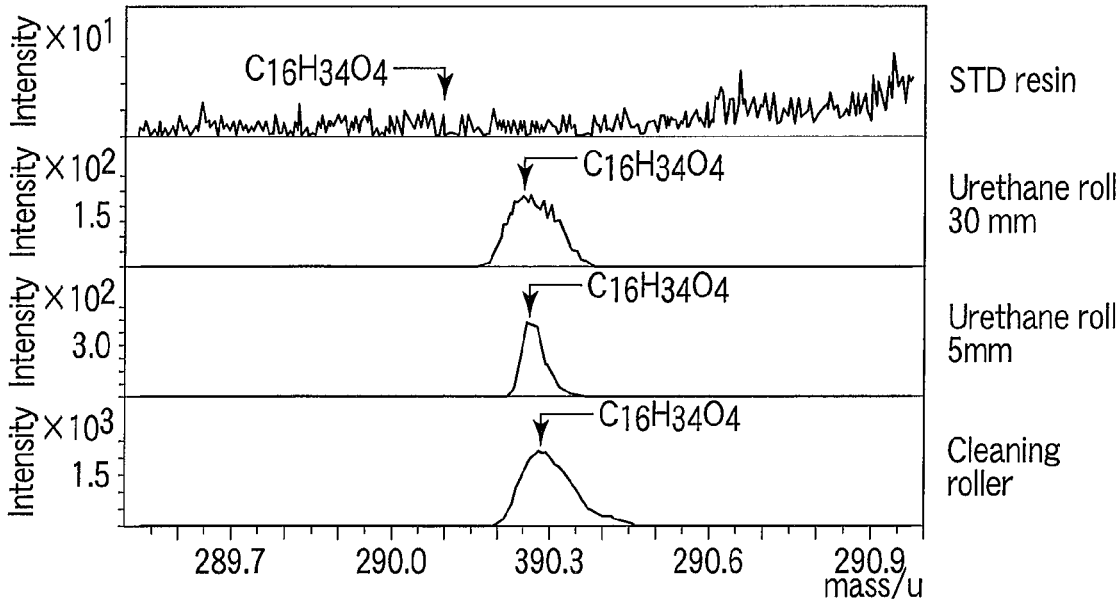
FIG. 6 is a graph showing analysis spectrum of components which has been transferred from a cleaning roller to a urethane rubber roller.
Figure 7:
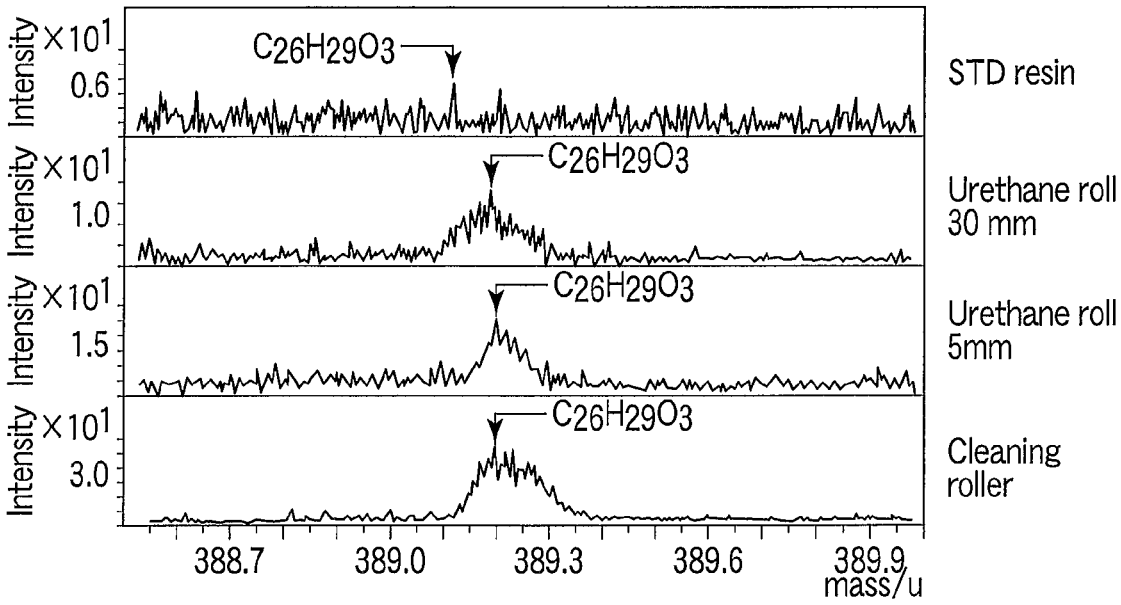
FIG. 7 is a graph showing analysis spectrum of components which have been transferred from a cleaning roller to a urethane rubber roller.
Figure 8:
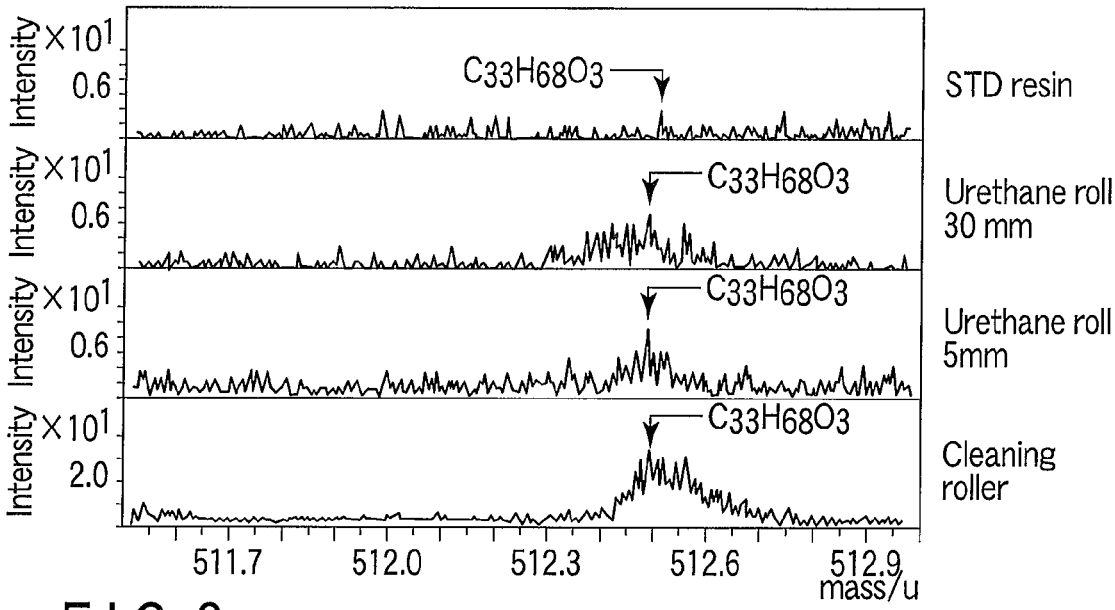
FIG. 8 is a graph showing analysis spectrum of components which have been transferred from a cleaning roller to a urethane rubber roller.

Specifically, as shown in FIG. 4, in an experiment where butyl rubber with an SP value of 7.8 was used as a cleaning roller material to the platen roller 2 made of urethane rubber, swelling occurred.

Results obtained by analyzing a platen roller made of urethane rubber and a cleaning roller made of butyl rubber before and after swelling utilizing time-of-flight secondary ion mass spectrometry (TOF-SIMS) are shown in FIGS. 5 to 8.

In FIGS. 5 to 8, four kinds of components were detected as components which were determined as components which were not contained in a platen roller before use but were contained in a cleaning roller made of butyl rubber and which were transferred to the platen roller after use. Chemical formulae of these components are $C_{14}H_{30}O_3$, $C_{16}H_{34}O_4$, $C_{26}H_{29}O_3$, $C_{33}H_{68}O_3$, or the like.

These components were infinitesimal but they were interfacial active agents added for charging prevention or bleed oxidation prevention, or the like, and since they were high in compatibility with the urethane roller with an SP value of 10 or so, they caused the urethane roller to swell. Though such swelling is fine and so not problematic in an ordinary application, size fluctuation of ±20 μm or more is not allowable as a platen roller for printing of a transfer film system.

Therefore, a first rubber sheet obtained by removing antistatic agent from butyl rubber, a second rubber sheet obtained by interfacial active agent from butyl rubber, a third rubber sheet obtained by blending antistatic agent and interfacial active agent into butyl rubber, and a fourth rubber sheet obtained by removing antistatic agent and interfacial active agent from butyl rubber were prepared, respectively, and an experiment that rollers configured by winding the first to fourth rubber sheets on different urethane rollers instead of the cleaning roller 20 were brought into contact with a platen roller and rotated for 20 hours were performed.

Figure 9:
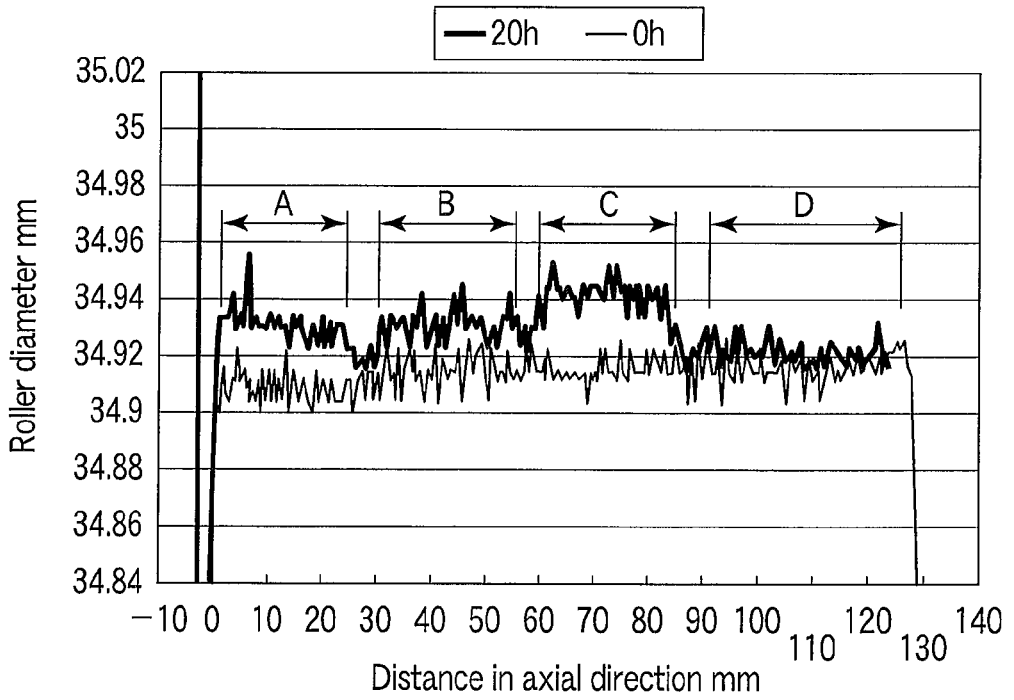
FIG. 9 is a graph showing swelling of a platen roller showing influence of transfer component additives contained in a butyl rubber in a comparison manner.

A result obtained by measuring diametric changes of the platen rollers 2 made of urethane rubber in their axial directions after the experiment is shown in FIG. 9.

In FIG. 9, a region A shows a diametric fluctuation measurement result of a portion of the platen roller 2 on which the first rubber sheet obtained by removing antistatic agent whose SP value (9.0) was close to that of the urethane roller from butyl rubber was wound, a region B shows a diametric fluctuation measurement result of a portion of the platen roller 2 on which the second rubber sheet obtained by removing interfacial active agent whose SP value (9.0) was close to that of the urethane roller from butyl rubber was wound, a region C shows a diametric fluctuation measurement result of a portion of the platen roller 2 on which the third rubber sheet obtained by blending antistatic agent and interfacial active agent into butyl rubber was wound, and a region D shows a diametric fluctuation measurement result of a portion of the platen roller 2 on which the fourth rubber sheet obtained by removing antistatic agent and interfacial active agent from butyl rubber was wound.

That is, it is found that swelling occurs in the platen rollers on regions A and B brought into contact with the rollers including one of antistatic agent and interfacial active agent, swelling of the platen roller 2 further increases on region C brought into contact with the roller containing antistatic agent and interfacial active agent, and swelling of a platen roller does not occur on region D brought into contact with the roller which does not contain antistatic agent and interfacial active agent.

As described above, when substances with an SP value close to 10.0 in substances blended in the material for the cleaning roller 20 as additive agents such as plasticizing agent, age inhibitor, cross-linking promoter, or workability improving agent are contained in material for the cleaning roller 20, even if amounts thereof are small, a degree of swelling reaches a problematic level according to continuation of transfer of these substances to the platen roller 2 for a long term.

Accordingly, not only the SP value of rubber but also the SP values of addition ingredients in the rubber are problematic in selection of rubber material for the cleaning roller 20.

In the case of the abovementioned butyl rubber, unless it contains a blended agent whose SP value is close to that of the platen roller 2, a difference of the SP value of about 2.0 occurs, the butyl rubber does not cause the platen roller 2 made of urethane rubber to swell.

That is, a rubber material for the cleaning roller 20 need to be a rubber material added with an addition ingredient whose SP value is different from that of a rubber material for the platen roller 2 by at least 2.

Incidentally, even if swelling of the platen roller 2 due to component transfer from the cleaning roller 20 is prevented, such a phenomenon that a diameter of the platen roller 2 shrinks according to degree of use takes place. This is because the diameter of the platen roller 2 shrinks due to volatilization of volatile component from constituent components of the platen roller 2 caused by temperature rising of interior of the transfer film system printer to 35 to 50° C. The shrinkage causes lowering of pressure contact force between the platen roller 2 and the thermal head 1, which results in impossibility of optimal printing.

In this embodiment, urethane rubber or PTE having a two-phase mixing tissue structure of hard segment and soft segment has been proposed as rubber material for the abovementioned platen roller 2, and it has been also proposed to perform heating at a temperature of 35° C. or higher to remove volatile component before a finishing working step as a size stabilizing treatment of these rubber materials.

In the case of the urethane rubber, a highest temperature of use is 90° C. and it is recommended that the urethane rubber is heated in a temperature range from 50 to 60° C. because oxidation degradation or hydrolysis becomes severe at a temperature exceeding 90° C.

In the embodiment of the present invention, urethane rubber was used for the platen roller 2 shown in FIG. 1. An apparent hardness Ha where influence of a cored bar to hardness of the platen roller 2 was added was 80. Silicone rubber was used in the cleaning roller 20 clearing a surface of the platen roller 2 as needed.

The SP value of urethane rubber configuring the platen roller 2 is 10 and the SP value of the silicone rubber configuring the cleaning roller 20 is 7.3, where a difference of 2.7 is present between both the SP values. As a vulcanization agent contained in silicone rubber, there are kinds of material blended with material with an SP value of 9.0 or higher such as 2.4 dichlorobenzoyl peroxide, benzoyl peroxide, or dicumyl peroxide, but since remaining vulcanization agent which is not used by secondary vulcanization treatment at 200° C. for 4 hours is decomposed, there is substantially little transfer component.

In this embodiment, the cleaning roller 20 was prepared using silicone rubber which was subjected to secondary vulcanization.

Figure 10:
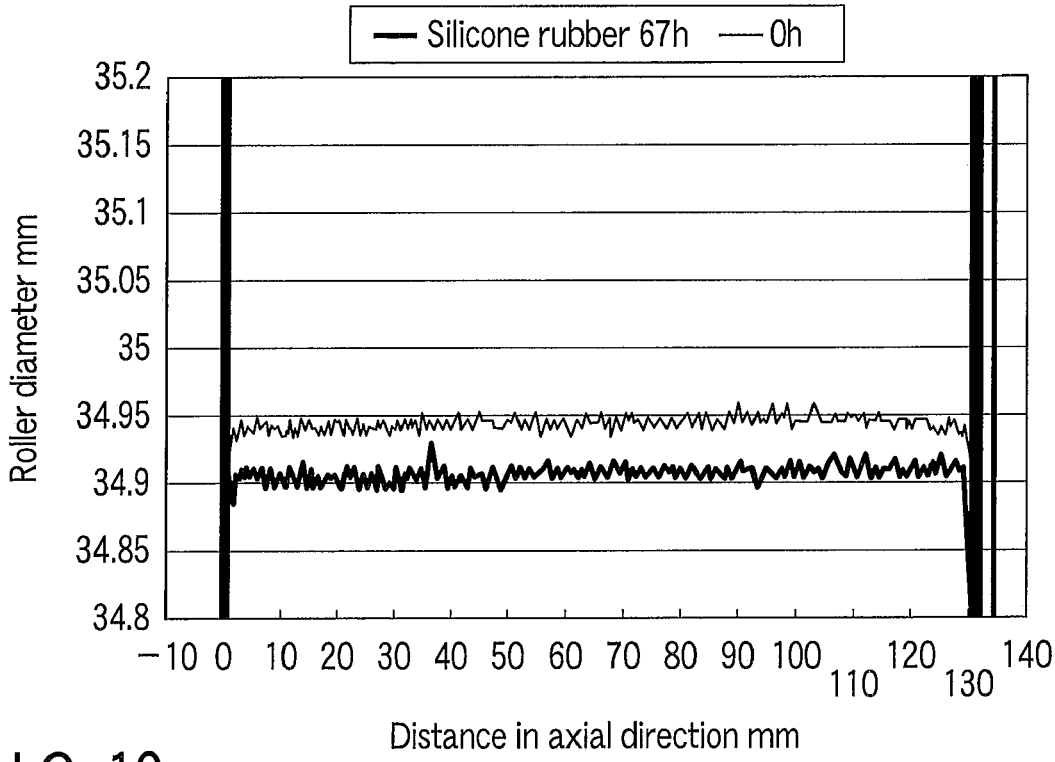
FIG. 10 is a graph showing diametric fluctuation of a platen roller made of urethane rubber before and after use thereof in a case that a cleaning roller made of silicone rubber is used.

FIG. 10 shows a diametric measurement result of a platen roller made of urethane rubber before and after a cleaning roller made of silicone rubber was used to the platen roller for 67 hours.

The diameter of the platen roller shrinks by about 0.04 mm as compared with the diameter of the platen roller before use (0 hours), but a shape of the platen roller in the axial direction thereof after use is approximately the same as that before use.

Figure 11:
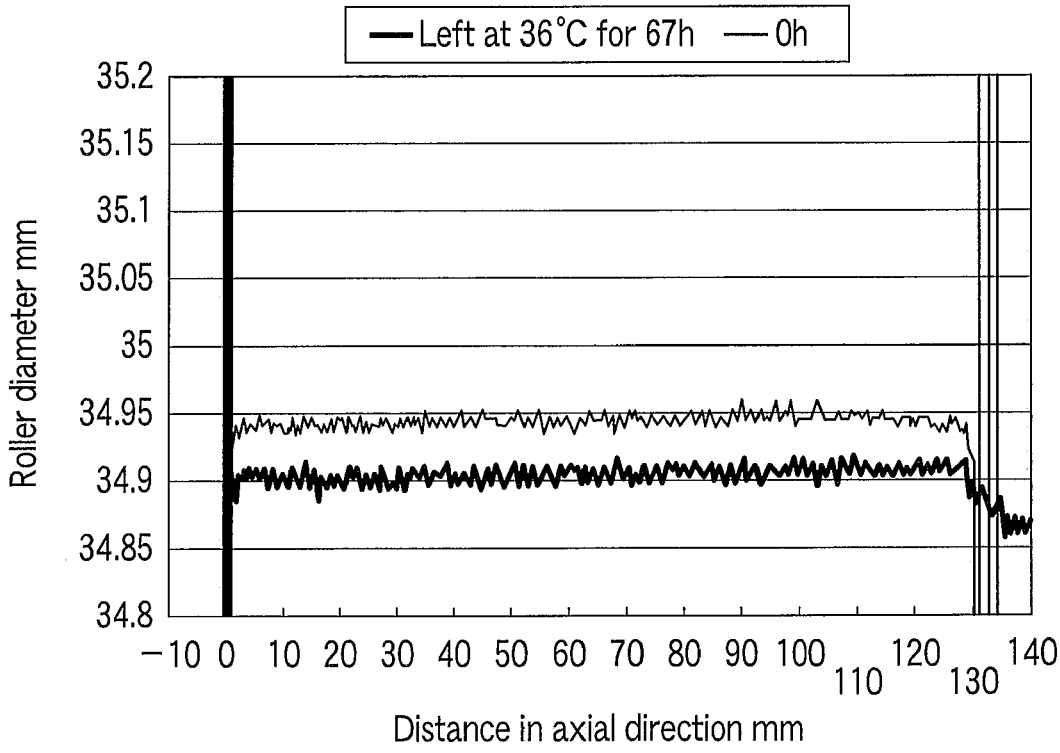
FIG. 11 is a graph showing diametric fluctuation of platen roller made from urethane rubber before and after use thereof in a case that a roller made of aluminum alloy is used instead of a cleaning roller made of silicone rubber.

FIG. 11 shows a diametric change of a platen roller made of urethane rubber when a roller made of aluminum alloy instead of the cleaning roller was applied to the platen roller in the atmosphere at a temperature of 36° C. for 67 hours in comparison with the above case.

It was observed that the diameter of the platen roller shrank by about 0.04 mm as compared with the diameter of the platen roller before use. This is because a volatile component in the platen roller made of urethane rubber was volatized.

The degree of shrinkage of the platen roller made of urethane rubber is the same as that of the platen roller under the application condition of the cleaning roller made of silicone rubber and shown in FIG. 10, which shows such a fact that component transfer of the cleaning roller made of silicone rubber did not occur.

That is, by applying silicone rubber whose SP value is different from the SP value of the urethane rubber of the platen roller by about 2.7 to the cleaning roller, the diametric fluctuation of the platen roller in the roller axial direction due to swelling can be prevented.

In the diametric measurement results shown in FIGS. 10 and 11, the diametric size of the platen roller after use shrank as compared with the diametric size of the platen roller before use, as described above. An experimental result under the same condition as that shown in FIG. 10 corresponding to the case that the urethane rubber roller which had been subjected to heating treatment in the atmosphere at 60° C. for 40 hours in advance was used is shown in FIG. 12.

Figure 12:
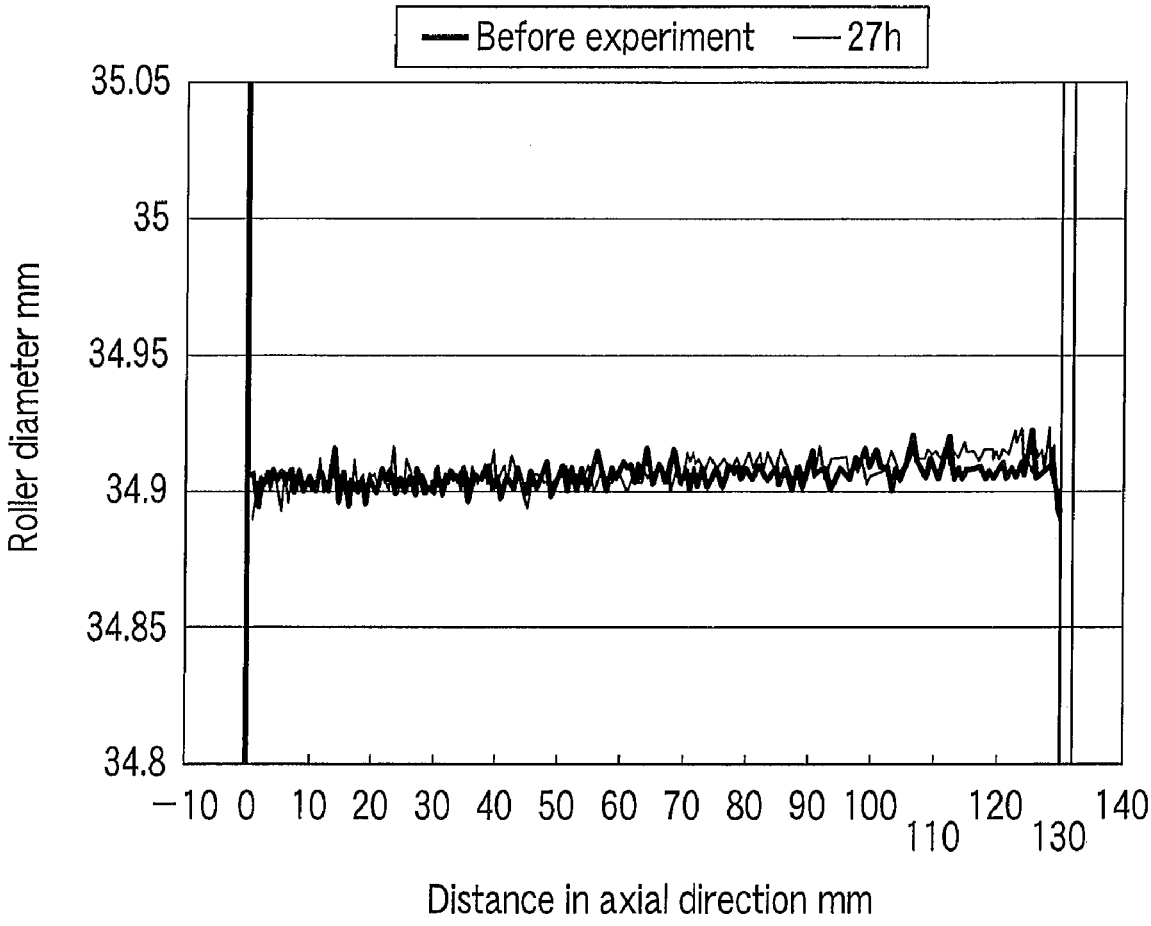
FIG. 12 is a graph showing diametric fluctuation of a platen roller when the platen roller made of urethane rubber, which has been subjected to finishing polishing after heating treatment is used.

In FIG. 12, a shrinking phenomenon of a platen roller made of urethane rubber and subjected to heating treatment does not occur between before and after applied with a cleaning roller made silicone rubber for 27 hours. This fact shows that it is important to perform heating treatment before performing a polishing step in order to obtain high diametric precision of the platen roller.

Figure 13:
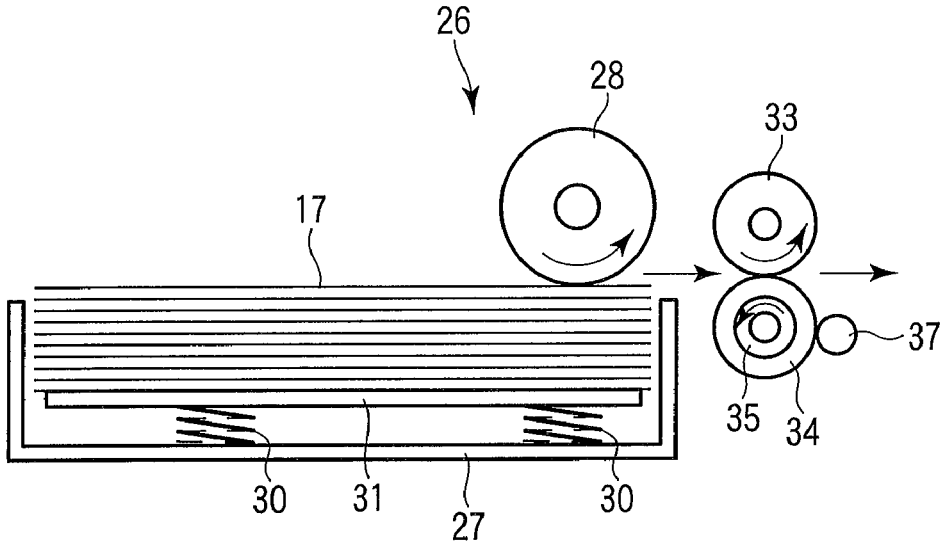
FIG. 13 is a diagram showing a supplying apparatus for a medium provided in the printing apparatus shown in FIG. 1.

FIG. 13 shows the supplying apparatus 26 for supplying the abovementioned medium 17 to the image transfer section 14.

The supplying apparatus 26 is provided with a cassette 27 serving as an accommodation portion accommodating media 17 in a stacked state, and a taking-out roller 28 for taking out a medium 17 is provided above the cassette 27. A placement plate 31 biased upwardly by springs 30 is provided within the cassette 27. Media 17 are placed on the placement plate 31 so that the uppermost medium is pushed to the taking-out roller 28. The taking-out roller 28 is rotated in a counterclockwise direction, as shown by arrow, to take out a medium 17.

A feeding roller 33 is provided on a medium taking-out side of the cassette 27, and a separation roller 34 made of urethane rubber is provided under the feeding roller 33 in a state that the separation roller 34 contacts with the feeding roller 33. A torque limiter 35 is provided on a rotating shaft of the separation roller 34.

The feeding roller 33 is rotated in a counterclockwise direction, as shown by arrow, to feed a medium 17. The separation roller 34 is configured such that, when a sheet of medium 17 is fed by the feeding roller 33, the separation roller 34 is rotated according to rotation of the feeding roller 33 in a direction of feeding out the sheet of medium 17 and when two sheets of media 17 are fed out by the feeding roller 33, the separation roller 34 is rotated in a reverse direction to the rotational direction of the feeding roller 33 to reversely rotate the second medium 17 and separate the second medium 17 from the first medium 17, so that media 17 can be fed out one by one.

A cleaning roller 37 made of butyl rubber for cleaning a surface of the separation roller 34 is brought into contact with the separation roller 34. The cleaning roller 37 is configured like the cleaning roller 20 for the abovementioned platen roller 2.

That is, the cleaning roller 37 is configured such that SP values (dissolution parameter) of the cleaning roller 37 and all additives added in the cleaning roller 37 have differences of at least 2.0 from the SP value of the separation roller 34.

Accordingly, the additives in the cleaning roller 37 is prevented from transferring to the separation roller 34 so that swelling of the separation roller 34 can be prevented and excellent separation effect can be maintained.

Figure 14:
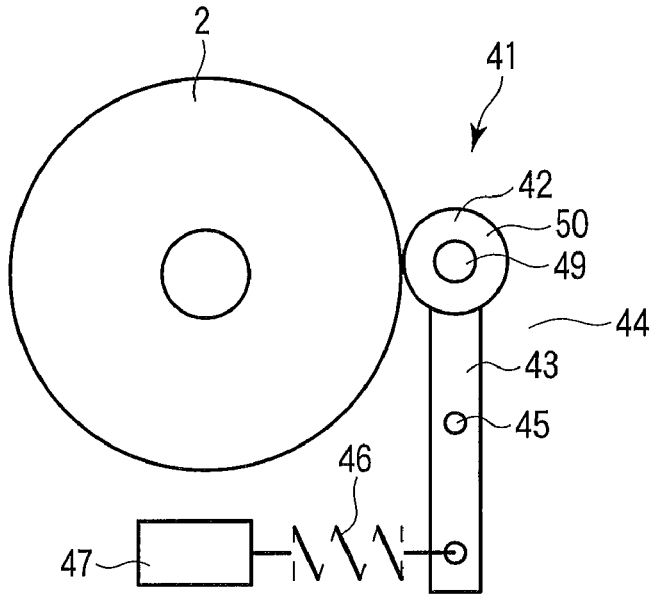
FIG. 14 is a diagram showing another example of the cleaning apparatus shown in FIG. 1.

FIG. 14 shows a cleaning apparatus 41 which is another example.

In FIG. 14, reference numeral 42 denotes a cleaning roller made of butyl roller, which comes in contact with one side face portion of a platen roller 2 made of urethane roller, and having hardness of about Ha 80°, where the cleaning roller 42 is pressed on the platen roller 2 by a pressing device 44. The pressing device 44 is provided with a rotating lever 43, and the cleaning roller 42 is rotatably attached to an upper end portion of the rotating lever 43. The rotating lever 43 is rotatably supported at its intermediate portion by a supporting shaft 45, and a solenoid 47 is connected to a lower end portion of the rotating lever 43 via a spring member 46.

The cleaning roller 42 comprises a cored bar 49 and a rubber layer 50 covering the cored bar 49, where apparent hardness reflecting influence of the cored bar 49 is suppressed to Ha 50° or less. Since hardness of the cleaning roller 42 is lowered in this manner, excellent contact can be achieved without raising pressing force of the cleaning roller 42 to the platen roller 2.

Accordingly, such a merit can be obtained that a transfer speed of the additives in the cleaning roller 42 to the platen roller 2 can be delayed and swelling of the platen roller 2 can be reduced.

Incidentally, when hardness of the cleaning roller 42 is raised, since such a phenomenon that the cleaning roller 42 is flipped up at a time of rotation of the platen roller 2 so that it does not contact with the platen roller 2 excellently takes place, it is necessary to raise the pressing force of the cleaning roller 42 to the platen roller 2 to some extent. When the pressing force is raised, a nip width between the platen roller 2 and the cleaning roller 42 becomes large and the transfer speed of additives in the cleaning roller 42 to the platen roller 2 is increased, which results in such a problem that swelling of the platen roller 2 increases.

The pressing force of the cleaning roller 42 to the platen roller 2 may be lowered by adjusting the pressing force of the pressing device 44.

That is, the pressing pressure of the cleaning roller 42 is arbitrarily controlled according to a spring constant and a length of the spring member 46 and a movement distance of the solenoid 47. According to this control, the pressing pressure of the cleaning roller 42 is set such that a nip depth between the platen roller 2 and the cleaning roller 42 is 0.5 mm or less.

Figure 15:
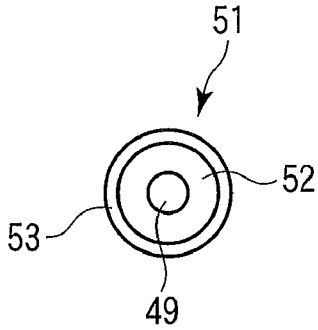
FIG. 15 is a diagram showing another example of a cleaning roller shown in FIG. 1.

Further, the pressing force of the cleaning roller to the platen roller 2 may be lowered by configuring a cleaning roller 51 as shown in FIG. 15.

That is, the cleaning roller 51 has a double layer structure comprising a sponge layer 52 configuring an inner portion of the cleaning roller 51 and a thin rubber layer 53 with a thickness of about 1 to 2 mm configuring an outer portion.

Thereby, even if the contact pressure is lowered to a deformation starting stress of the cleaning roller 51, contact between the platen roller 2 and the cleaning roller 42 can be maintained.

Figure 16:
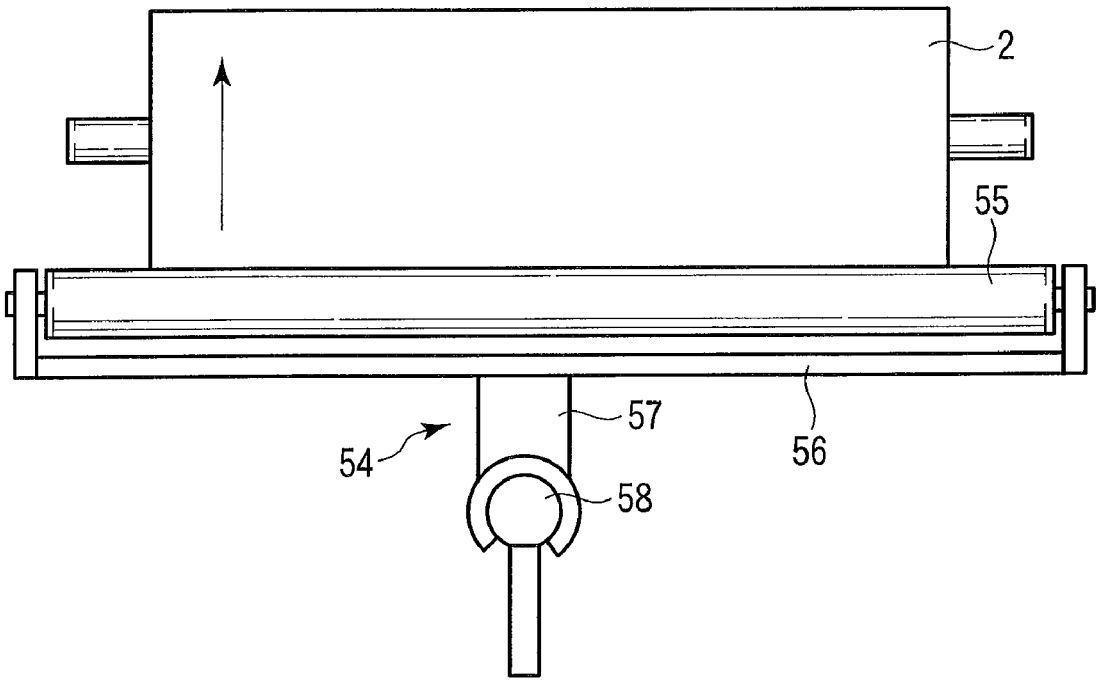
FIG. 16 is a plan view showing another supporting structure of the cleaning roller shown in FIG. 1.
Figure 17:
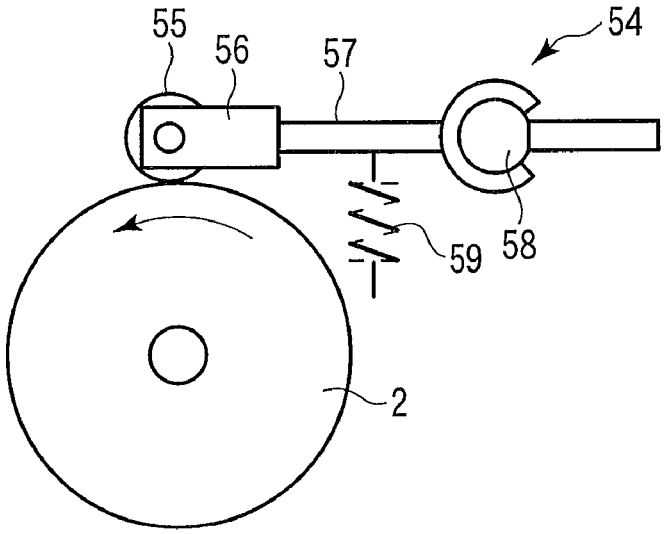
FIG. 17 is a side view showing the supporting structure shown in FIG. 16.

FIGS. 16 and 17 show another supporting structure of the cleaning roller.

That is, both end portions of a cleaning roller 55 are rotatably supported by a holding frame 56. The holding frame 56 is rotatably supported at its central portion via a coupling member 57 and a universal joint 58 configuring a supporting device 54. The coupling member 57 is elastically biased downwardly by a spring member 59, so that the cleaning roller 55 is brought into pressure contact with an upper face portion of the platen roller 2.

When the platen roller 2 is rotated, the cleaning roller 55 is rotationally driven according to the rotation of the platen roller 2 to clean a surface of the platen roller 2. At the cleaning time, the holding frame 56 for the cleaning roller 55 is freely rotated about the universal joint 58, so that the shaft of the cleaning roller 55 becomes parallel to the shaft of the platen roller 2 and becomes perpendicular to a rotational direction of the platen roller 2. Thereby, the cleaning roller 55 is prevented from contacting with the platen roller 2 eccentrically, so that even contact of the cleaning roller 55 with the platen roller 2 in the axial direction can be achieved.

Accordingly, since the additives in the cleaning roller 55 are transferred to the platen roller 2 evenly along the axial direction of the platen roller 2, the shape of the cleaning roller 55 in the axial direction thereof can be made straight. Therefore, such a merit can be obtained that a dark and light pattern does not occur in an image on a printed matter and print quality can be maintained excellently.

Incidentally, when the cleaning roller 55 contacts with the platen roller 2 eccentrically, transfer of additives occurs on only the contact portion, so that the shape of the platen roller 2 in the axial direction thereof can not be kept straight. Therefore, such a problem arises that a dark and light pattern occurs in an image on a printed matter and print quality is largely damaged.

Second Embodiment

Figure 18:
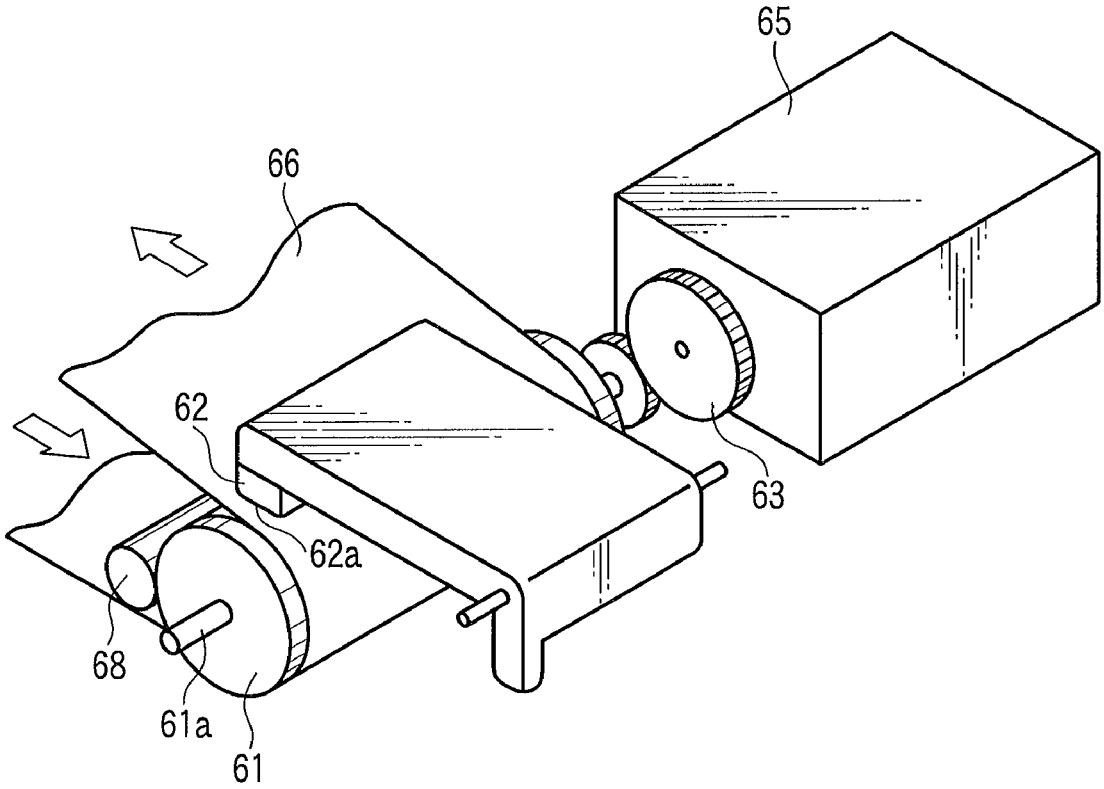
FIG. 18 is a perspective view showing a printing apparatus according to another embodiment of the present invention.

FIG. 18 shows a thermal printer according to a second embodiment of the present invention.

The thermal printer is provided with a platen roller 61 made of urethane rubber and rotatably supported at its central shaft of the platen roller 61, and a thermal head 62 comes in contact with a circumferential face portion of the platen roller 61. A stepping motor 65 is connected to the central shaft 61*a* via a gear train 63, so that the platen roller 61 is rotationally driven by the stepping motor 65. A plurality of heat generating elements 62*a* facing the platen roller 61 are continuously arranged in a array shape on a lower face portion of the thermal head 62.

In the thermal printer thus configured, when image printing is performed on a thermal paper 62 serving as a medium to be printed, while the thermal head 66 is brought into pressure contact with the circumferential face of the platen roller 61 via the thermal paper 66, the platen roller 61 is rotationally driven and the heat generating elements 62*a* of the thermal head 62 are selectively driven. Thereby, the thermal paper 66 is conveyed and an image of dot matrix form is formed on the thermal paper 66 according to heat generation and scanning of the thermal head 62.

Figure 19:
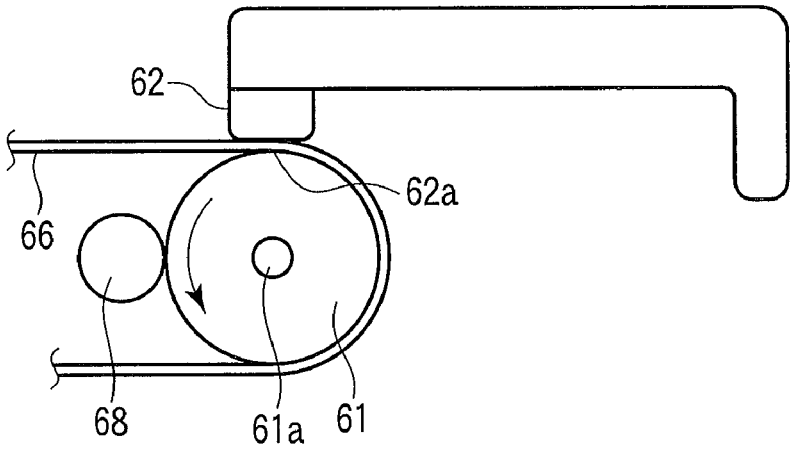
FIG. 19 is a side view showing the printing apparatus shown in FIG. 18.

A cleaning roller 68 made of butyl rubber is brought into contact with one side face portion of the platen roller 61, as also shown in FIG. 19. The cleaning roller 68 is also configured like the cleaning roller 20 of the first embodiment described above.

That is, the cleaning roller 68 is configured such that SP values (dissolution parameters) of the cleaning roller 68 and all additives added in the cleaning roller 68 have differences of at least 2.0 from the SP value of the platen roller 61.

Accordingly, transfer of the additives in the cleaning roller 68 to the platen roller 61 is blocked so that swelling of the platen roller 61 can be prevented and excellent print quality can be maintained.

Figure 20:
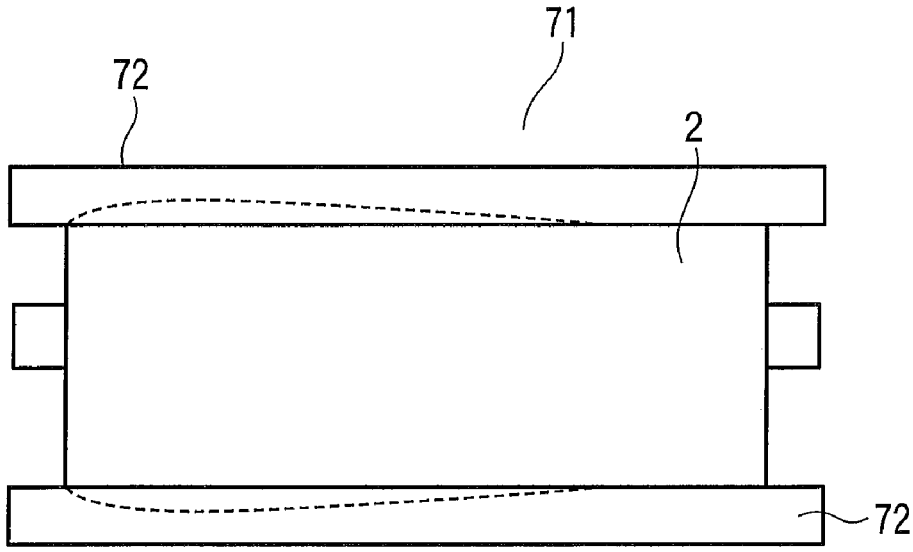
FIG. 20 is a diagram showing an apparatus for correcting swelling of a platen roller.

FIG. 20 shows a correction apparatus 71 for correcting the swollen platen roller 2.

That is, in FIG. 20, reference numeral 72 denotes correction plates, where the correction plates 72 are arranged so as to contact with upper and lower faces of the platen roller 2 to be corrected. As the correction plate 72, a grinding stone or the like is used.

Figure 21:
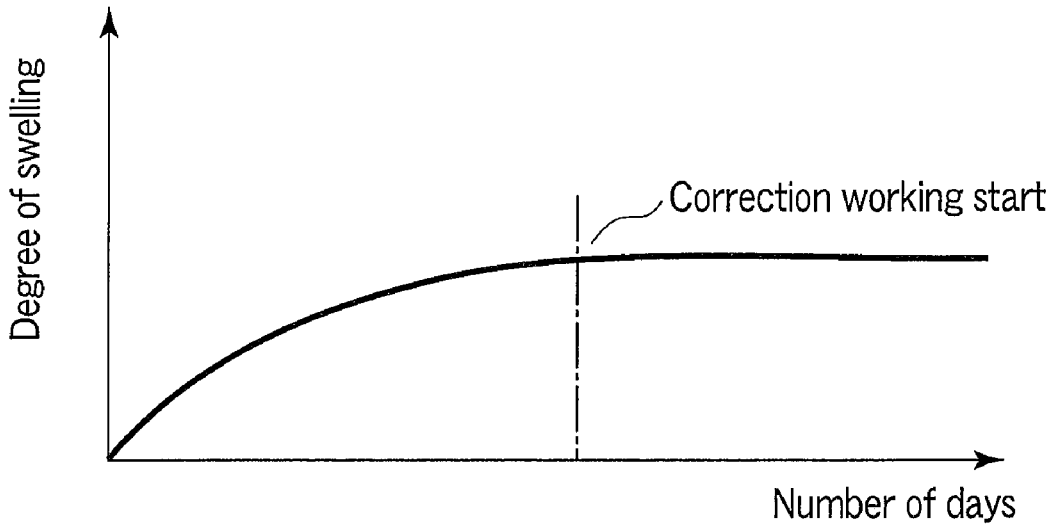
FIG. 21 is a diagram showing a time at which swelling correction of the platen roller starts.

A degree of swelling of the platen roller 2 increases according to number of days of use, as shown in FIG. 21, but correction of the swelling is performed after the swelling is saturated.

When the swelling of the platen roller 2 is saturated, the platen roller 2 is detached, it is set between the correction plates 72, and the platen roller 2 is rotated in a state that it is brought into pressure contact with the correction plates 72. Thereby, the surface of the platen roller 2 is polished and the swelling is corrected so that reuse of the platen roller 2 can be made possible.

Incidentally, the surface of the platen roller 2 may be polished using correction rollers instead of the correction plates.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cleaning apparatus for a roller comprising:

a roller; and a cleaning roller brought into contact with the roller to clean a surface of the roller, wherein the cleaning roller further comprises a roller portion and additives added into the roller portion, and the cleaning roller is configured such that each of SP values (dissolution parameter) of the cleaning roller and of the additives have differences of at least 2.0 from an SP value of the roller.

2. The cleaning apparatus for a roller according to claim 1, wherein the cleaning roller further comprises a core metal and a rubber layer which covers the core metal, and has an apparent hardness of Ha50 degrees or less, in which an influence of the core metal is reflected.

3. The cleaning apparatus for a roller according to claim 1, further comprising a pressing device pressing the cleaning roller to the roller with such a pressing force that the nip depth becomes 0.55 mm or less.

4. The cleaning apparatus for a roller according to claim 1, wherein the cleaning roller has a double layer structure of a sponge layer configuring an inner portion of the clearing roller and a rubber layer thinner than the sponge layer, configuring an outer portion of the cleaning roller.

5. The cleaning apparatus for a roller according to claim 1, further comprising a supporting device supporting the cleaning roller in parallel with the roller.

6. The cleaning apparatus for a roller according to claim 1, wherein the roller is made of rubber material, and the cleaning roller is made of rubber material added with additive whose SP value is at most 8.

7. The cleaning apparatus for a roller according to claim 1, wherein the roller is made of rubber material subjected to heating treatment at a temperature equal to or higher than a temperature at a time of use of the roller before the rubber material is finished to a roller shape.

8. A printing apparatus comprising:

a thermal head brought into pressure contact with an ink ribbon superimposed on an intermediate transfer film to heat the ink ribbon, thereby printing an image on the intermediate transfer film;

a platen roller supporting the ink ribbon and the intermediate transfer film with which the thermal head is brought into pressure contact, a transfer device transferring the image printed on the intermediate transfer film to a body to be transferred at a transfer position, and a cleaning roller brought into contact with the platen roller to clean a surface of the platen roller, wherein the cleaning roller further comprises a roller portion and additives added into the roller portion, and the cleaning roller is configured such that each of SP values (dissolution parameter) of the cleaning roller and of the additives have differences of at least 2.0 from a SP value of the platen roller.

9. The printing apparatus according to claim 8, wherein the cleaning roller further comprises a core metal and a rubber layer which covers the core metal, and has an apparent hardness of Ha50 degrees or less, in which an influence of the core metal is reflected.

10. The printing apparatus according to claim 8, further comprising a pressing device pressing the cleaning roller to the roller with such a pressing force that the nip depth becomes 0.55 mm or less.

11. The printing apparatus according to claim 8, wherein the cleaning roller has a double layer structure of a sponge layer configuring an inner portion of the clearing roller and a rubber layer thinner than the sponge layer, configuring an outer portion of the cleaning roller.

12. The printing apparatus according to claim 8, further comprising a supporting device supporting the cleaning roller in parallel with the roller.

13. The printing apparatus according to claim 8, wherein the platen roller is made of rubber material, and the cleaning roller is made of rubber material added with additive whose SP value is at most 8.

14. The printing apparatus according to claim 8, wherein

The platen roller is made of rubber material subjected to heating treatment at a temperature equal to or higher than a temperature at a time of use of the roller before the rubber material is finished to a roller shape.

15. The printing apparatus according to claim 8, wherein the intermediate transfer film is a polyethylene terephthalate (PET) film, and the platen roller is made of such rubber material that its friction coefficient to the PET film is 0.75 or higher under a condition of a load of 50 g and a sliding speed of 10 mm/sec.

16. The printing apparatus according to claim 8, wherein the platen roller comprises rubber material having a two-phase mixing tissue structure of hard segment and soft segment.

17. The printing apparatus according to claim 8, further comprising:

an accommodation section accommodating the bodies to be transferred in a stacking state of the bodies to be transferred, a taking-out roller taking out the body to be transferred accommodated in the accommodation section, a feeding roller feeding the body to be transferred taken out by the taking-out roller toward the transfer position, a separation roller brought into contact with the feeding roller in a rolling manner and rotated in a reverse direction to a rotational direction of the feeding roller to separate the bodies to be transferred from each other, and a cleaning roller for a separation roller brought into contact with the separation roller to clean a surface of the separation roller, wherein the cleaning roller for a separation roller further comprises a roller portion and additives added into the roller portion, and the cleaning roller is configured such that each of SP values (dissolution parameter) of the cleaning roller and of the additives have differences of at least 2.0 from the SP value of the separation roller.

18. A printing apparatus comprising:

a thermal head brought into pressure contact with a medium to be printed to heat the medium to be printed, thereby printing an image on the medium to be printed;

a platen roller supporting the medium to be printed with which the thermal head is brought into pressure contact; and a cleaning roller brought into contact with the platen roller to clean a surface of the platen roller, wherein the cleaning roller further comprises a roller portion and additives added into the roller portion, and the cleaning roller is configured such that each of SP values (dissolution parameter) of the cleaning roller and of the additives has differences of at least 2.0 from an SP value of the platen roller.

* * * * *